US008105097B2

(12) United States Patent
Thijs et al.

(10) Patent No.: US 8,105,097 B2
(45) Date of Patent: Jan. 31, 2012

(54) BLANKING PLUG FOR TELECOMMUNICATIONS JACK

(75) Inventors: Danny Thijs, Zonhoven (BE); Didier Claeys, Schaffen (BE)

(73) Assignee: Tyco Electronics Raychem BVBA, Kessel-Lo (BE)

( * ) Notice: Subject to any disclaimer, the term of this patent is extended or adjusted under 35 U.S.C. 154(b) by 152 days.

(21) Appl. No.: 12/460,729

(22) Filed: Jul. 23, 2009

(65) Prior Publication Data

US 2010/0022115 A1 Jan. 28, 2010

(30) Foreign Application Priority Data

Jul. 23, 2008 (GB) ..... 0813455.3

(51) Int. Cl.
*H01R 13/44* (2006.01)

(52) U.S. Cl. ..... 439/148; 439/133

(58) Field of Classification Search ..... 439/148, 439/133, 509

See application file for complete search history.

(56) References Cited

U.S. PATENT DOCUMENTS

| | | | | |
|---|---|---|---|---|
| 4,964,284 | A * | 10/1990 | McDaid | 70/14 |
| 5,340,324 | A * | 8/1994 | Fields et al. | 439/133 |
| 5,598,455 | A * | 1/1997 | Bliven et al. | 379/22.04 |
| 5,975,936 | A * | 11/1999 | Lin et al. | 439/404 |
| 6,790,097 | B1 * | 9/2004 | Edwards et al. | 439/676 |
| 7,427,204 | B1 * | 9/2008 | Mangone | 439/148 |

FOREIGN PATENT DOCUMENTS

JP 11067371 A 3/1999

OTHER PUBLICATIONS

Search Report issued by the UK Intellectual Property Office, dated Nov. 12, 2008, for related Application No. GB0813455.3 (3 pages).
Manual of CTR-80A Cassette Recorder, Radio Shack, URL: http://goyim.dyndns.org:8080/coco/doc/manuals/Hardware/CTR80A.pdf [Accessed on Sep. 19, 2011].

* cited by examiner

*Primary Examiner* — Xuong Chung Trans
(74) *Attorney, Agent, or Firm* — Baker & Daniels LLP

(57) ABSTRACT

The present invention provides an electrical blanking plug for a telecommunications socket or jack. The blanking plug having at least one electrical conductor positioned on the body of the plug, which conductor on insertion of the plug into a telecommunications jack or socket electrically connects one or more terminals on the jack to short circuit and/or ground one or more electrical telecommunication circuits terminated at the jack.

18 Claims, 3 Drawing Sheets

BLANKING PLUG FOR TELECOMMUNICATIONS JACK

The present invention concerns an electrical blanking plug for a telecommunications jack, and in particular concerns a lockable blanking plug to prevent unauthorized access/connection to spare jacks in a telecommunications network.

Lockable blanking plug for modular type "RJ" jacks are known. Blanking plugs of this type are provided with a barrel lock and key so that they can be locked in position in any spare jacks that may exist at any location in a network to prevent unauthorized access to the jack and hence connection to the network. Spare jacks may be found in for example a patch panel, wall, floor or ceiling mounted sockets or the like.

Lockable blanking plugs of the aforementioned type provide adequate security in most network situations. However, in government and commercial buildings there is often a requirement for increased network security, particularly to prevent unauthorized network access via access points such as unused jacks.

According to an aspect of the present invention there is provided an electrical blanking plug for a telecommunications socket or jack; the said blanking plug having at least one electrical conductor positioned on the body of the plug, which conductor on insertion of the plug into a telecommunications jack or socket electrically connects one or more terminals on the said jack to short circuit and/or ground one or more electrical telecommunication circuits terminated at the jack.

This aspect of the present invention readily enables the blanking plug to short circuit the jack terminal contacts or "pins" to one another and/or to ground the shorted contacts in order to prevent unwanted effects such as cross-talk and induced currents.

The blanking plug conductor may comprise of at least one resilient element, which resiliently deflects against the terminals (contacts) on insertion of the plug into the jack. This arrangement readily ensures that the conductor is maintained in electrical contact with the jack contacts when the plug is inserted.

In preferred embodiments the conductor comprises a resilient metallic element, preferably in the form of a leaf spring such as a V-shape metallic clip or the like in which one arm of the clip is mounted to the body portion of the plug with the other arm being free to make electrical contact with the jack contacts. Preferably, the material of the resilient metallic element is a spring steel.

In preferred embodiments the conductor comprises at least one contact region for electrically connecting at least two of the jack terminals (contacts) together, and at least one further contact region for electrically grounding the jack terminals. This is particularly advantageous when used with modular type jacks having "ground" contacts adjacent to the contacts terminating the copper pairs of respective electrical telecommunications circuits.

The conductor is preferably positioned on the body of the plug to contact one or more pairs of electrical terminals arranged adjacent to one another in a modular type jack arrangement, that it to say it is preferred that the conductor is positioned in substantially the same place on the blanking plug as the contacts would be in a conventional cable termination plug of the same modular type. In this way the conductor may be positioned on the body of the plug so that when the plug is inserted in a jack the conductor is wholly located in the interior of the jack and thus protected in the same way that the contacts of cable termination plug are when inserted in the jack. In this way the plug also functions as a dust cover for the unused jack in which it is inserted. The plug of the present invention also provides for electromagnetic compatibility of the telecommunication circuits termination at the jack, protecting the live circuits from one another.

In preferred arrangements the conductor is located in a recess on the plug body. In one particular arrangement the conductor is provided with a pair of legs which locate in corresponding recesses provided on the plug body. For example; the legs may be provided on opposite sides of the conductor so that they contact corresponding grounding contacts on the jack when inserted.

In preferred embodiments the blanking plug is a lockable blanking plug comprising locking means for locking the plug in a respective jack to prevent unauthorized access and removal of the plug from the jack. Thus, not only does the blanking plug of the present invention provide security in the sense that the unused circuits are shorted and/or grounded but additionally provides physical security when inserted in an unused or spare jack.

It is to be understood that the term "jack" used herein is used to refer to any type of telecommunications socket for connection with a cable termination plug connected to a telecommunications cable. Further, the term "telecommunications" used herein refers to telecommunications in it's broadest sense including but not limited to voice and data telecoms etc.

Various embodiments of the present invention will now be more particularly described, with reference to the accompanying drawings, in which.

Where appropriate the same or similar components are referred to by the same reference numbers throughout.

Figure 1:
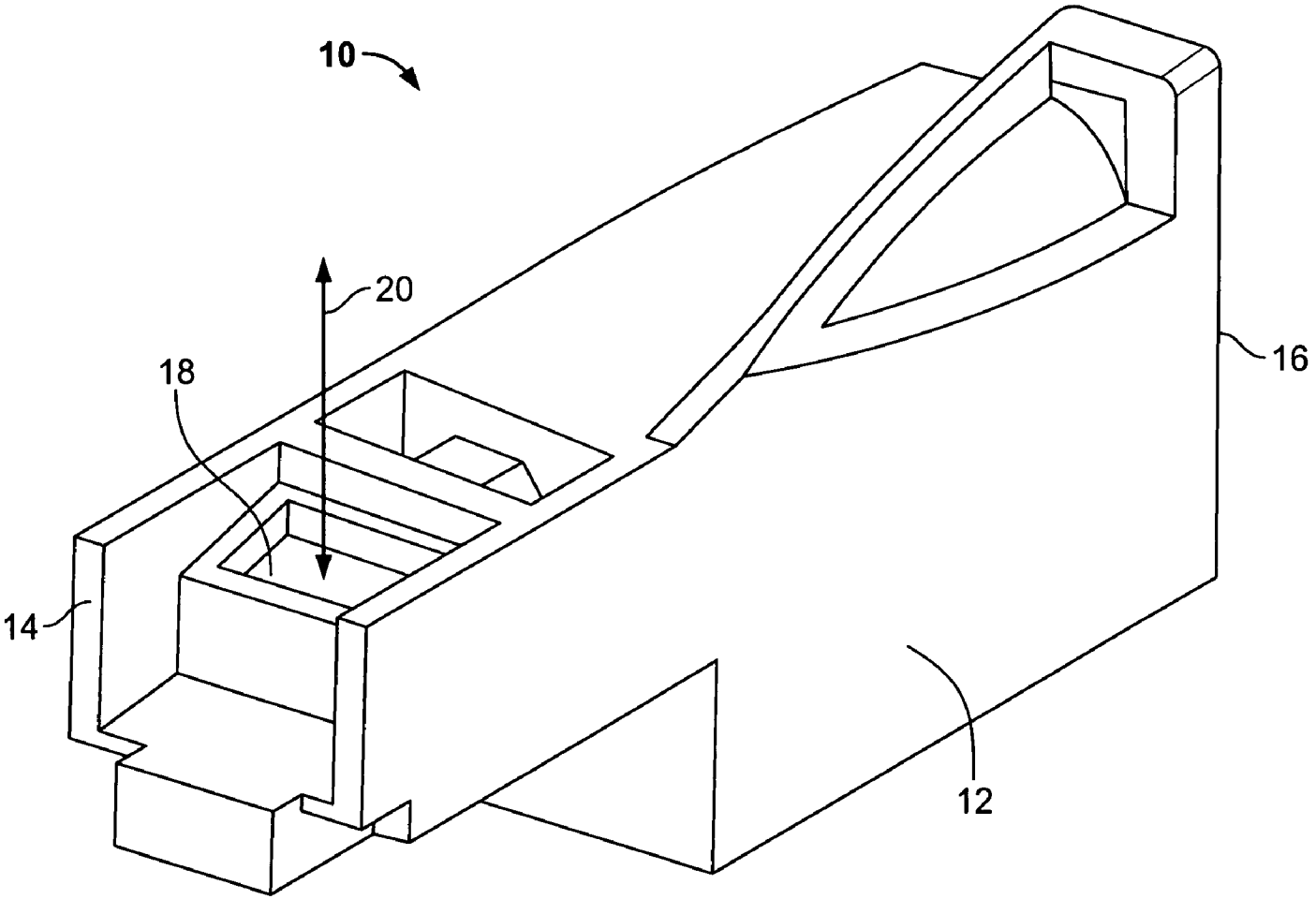
FIG. 1 is a perspective view of a known lockable blanking plug for a telecommunications jack.

Referring to FIG. 1, there is shown a known type of lockable blanking plug 10 for a modular telecommunications jack, in this case an "RJ45" modular jack is commonly used in telecommunication networks. The lockable blanking plug 10 comprises a generally rectangular body 12 of moulded plastics material having an insertion end 14 for location in a corresponding jack in which the blanking plug is to be fitted. The shape, size and configuration of the insertion end 14 corresponds to that of a corresponding cable plug of the same modular type, for example, a RJ45 jack in this case.

The plug 10 includes a locking function and is provided with a barrel lock (not shown) with a key opening for receiving a locking key at the other end 16 of the plug. In use a latch element 18 of the lock is moved between locked and unlocked position as in the direction as indicated at 20.

Figure 2:
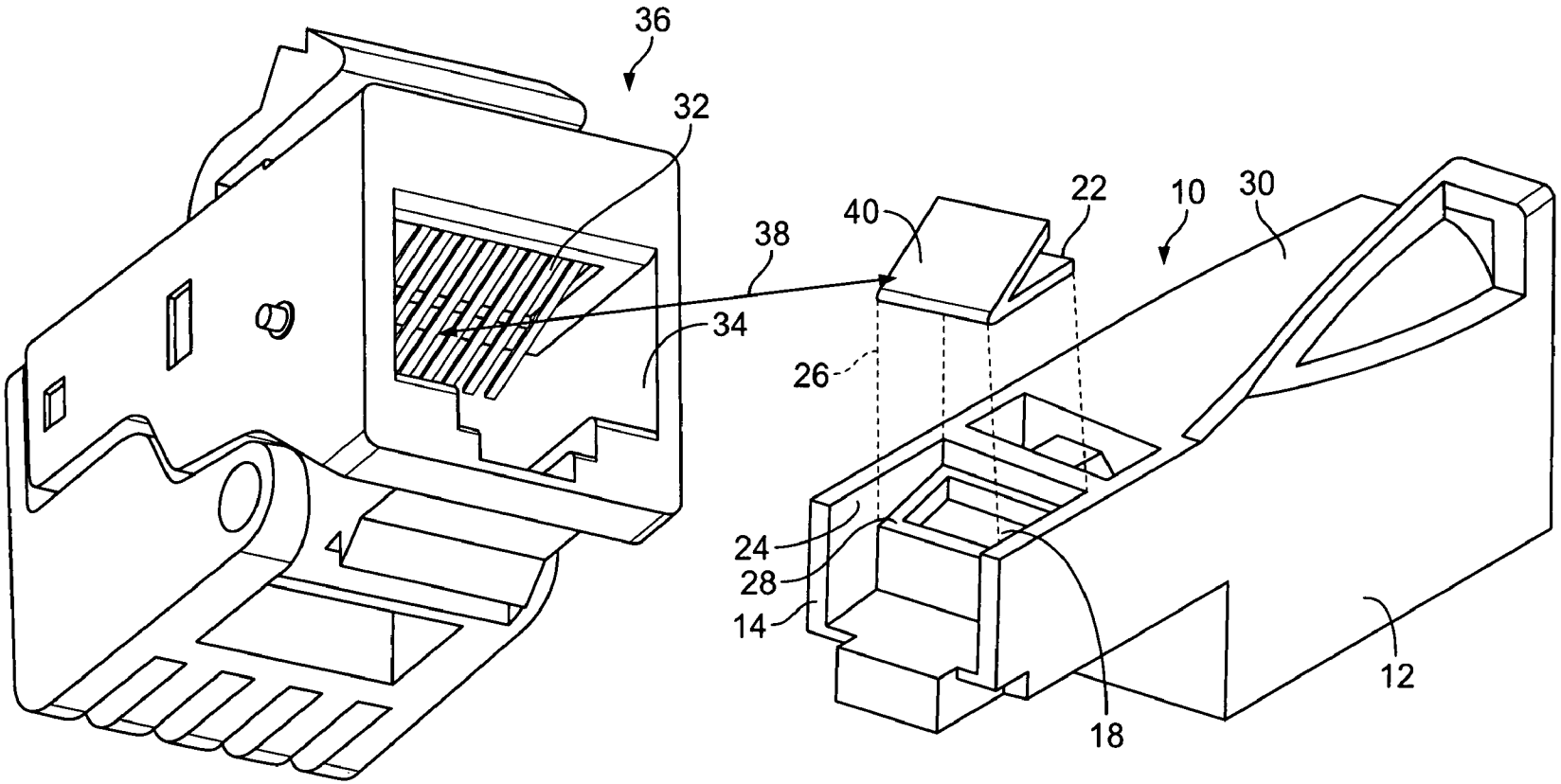
FIG. 2 is a perspective view of a blanking plug according to a first embodiment of the present invention, shown in combination with an unshielded telecommunications jack; and, FIG. 3 is a perspective view of a blanking plug according to a second embodiment of the present invention, shown in combination with a known type of shielded telecommunications jack.

Referring now to FIG. 2, in accordance with a first embodiment of the present invention the locking plug 10 is provided with a resilient metallic V-shape spring clip 22 which is mounted on the body portion 12 in a recess region 24 towards the insertion end 14 of the lockable blanking plug. Apart from the resilient metallic element 22 the lockable blanking plug 10 of FIG. 2 is identical to the blanking plug 10 shown in FIG. 1. The metallic element 22 sits in the recess 24 as indicated by the dashed lines 26. The metallic spring element sits on an inclined surface 28 in the recess 24. The inclined surface 28 surrounds an aperture in which the latch element 18 is located. The inclined surface 28 increases the angle of the projecting part of the element 22 with respect to the flat plane upper surface 30 of the plug so that the angle of the projecting part of the element substantially corresponds to the inclined region 32 in which the contact terminals of an RJ45 type modular jack 36 are located in the interior region 34 of the jack. As indicated at 38 the upward facing surface 40 of the metallic element 22 is arranged to contact the electrical terminal contacts 32 in the interior of the jack 36 when the blanking plug 10 is inserted. The shape and size of the upward facing surface 40 of the element 22 corresponds to the shape and size of the area containing the jack terminal contacts so that all terminals in the jack are short circuited to one another when the blanking plug of FIG. 2 is inserted in the jack.

As is well known in the art, a modular jack such as the RJ45 jack 36 shown in FIG. 2 comprises an array of contacts terminals or pins which terminate copper pairs in a telecommunications circuit. In the arrangement shown in FIG. 2 the jack 36 is an unshielded type jack and as such is not provided with ground contacts in the interior region thereof, only terminal contacts for the copper pairs.

Figure 3:
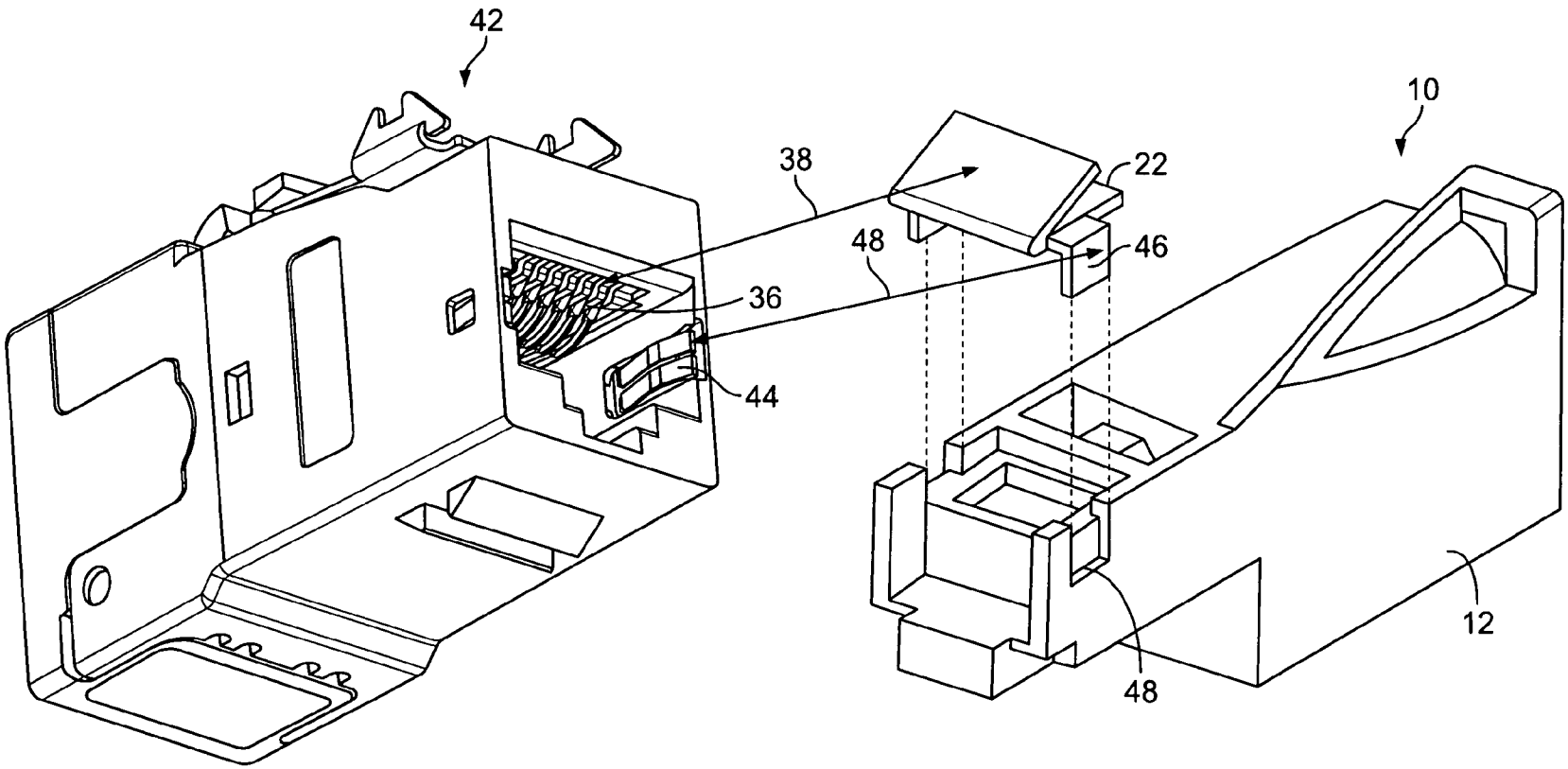

In a modified arrangement shown in FIG. 3 the jack 42 comprises a shielded RJ45 type modular jack having a pair of electrical ground contacts 44 positioned in the respective sidewalls thereof in a plane substantially orthogonal to the terminal contacts 36 terminating the copper pairs of the respective telecommunications circuits.

In the blanking plug embodiment of FIG. 3 the spring element 22 is slightly modified to include a pair of downwardly depending legs 46 on opposite sides of the spring element, which legs locate in corresponding cutaway slots 48 provided in the sidewalls to the recess region 24. The legs locate the spring element further with respect to the body of the plug with the outward facing surfaces of the legs proving an electrical contact area for the ground contacts 44 in the jack 42 as indicated at 48.

In the embodiment of FIG. 3 the lockable blanking plug not only provides for short circuiting the electrical terminals of the copper pairs but also provides a grounding function by electrically connecting the copper pair terminals only short circuit to the grounding contacts 44. In contrast in the embodiment of FIG. 2 functionality is presented.

In other embodiments the spring element may include gold plated contacts for electrical engagement with the contacts in the jack.

The invention claimed is:

1. An electrical blanking plug for a telecommunications socket or jack; the said blanking plug having at least one electrical conductor positioned on the body of the plug, which conductor on insertion of the plug into a telecommunications jack or socket electrically connects plural side by side terminals on the said jack to short circuit one or more electrical telecommunication circuits terminated at the jack.

2. An electrical blanking plug as claimed in claim 1, wherein the said conductor comprises at least one resilient element which resiliently deflects against the plural side by side terminals on the full insertion of the plug in a jack.

3. An electrical blanking plug as claimed in claim 2, wherein the said conductor comprises a resilient metallic element.

4. An electrical blanking plug as claimed in claim 2, wherein the said conductor is in the form of a leaf spring, the leaf spring being in the form of a reverse bend having a facing surface positioned at a corresponding angle with depending contacts in the complementary jack.

5. An electrical blanking plug as claimed in claim 1, wherein the said conductor comprises at least one contact for electrically connecting at least two jack terminals together, and at least one contact for electrically grounding said terminals.

6. An electrical blanking plug as claimed in claim 1, wherein the said conductor is positioned on the body of the said plug to contact one or more pairs of electrical terminals arranged adjacent one another in a modular type telecommunications jack.

7. An electrical blanking plug as claimed in claim 1, wherein the said conductor is positioned on the body of the plug such that when the plug is inserted in a jack the conductor is wholly located in the interior of the jack.

8. An electrical blanking plug as claimed in claim 1, wherein the said conductor is located in a recess on the plug body.

9. An electrical blanking plug as claimed in claim 1, wherein the said conductor is provided with a pair of legs located in corresponding recesses provided in the plug body.

10. An electrical blanking plug as claimed in claim 1, wherein the said plug further comprises locking means for locking the said plug in a respective jack to prevent unauthorized access and removal of the plug from the jack.

11. An electrical blanking plug for a telecommunications jack, the blanking plug comprising:

at least one electrical conductor positioned on the body of the plug, which conductor on insertion of the plug into a telecommunications jack or socket electrically connects one or more terminals on the said jack to short circuit one or more electrical telecommunication circuits terminated at the jack, and at least one contact for electrically grounding said terminals.

12. An electrical blanking plug as claimed in claim 11, wherein the said conductor comprises at least one resilient element which resiliently deflects against plural side by side terminals on insertion of the plug in a jack.

13. An electrical blanking plug as claimed in claim 12, wherein the said conductor comprises a resilient metallic element.

14. An electrical blanking plug as claimed in claim 12, wherein the said conductor is in the form of a leaf spring, the leaf spring being in the form of a reverse bend having a facing surface positioned at a corresponding angle with depending contacts in the complementary jack.

15. An electrical blanking plug as claimed in claim 11, wherein the said conductor overlies an outer surface of the plug body and at least one ground contact overlying a second surface of the plug body.

16. An electrical blanking plug as claimed in claim 15, wherein the at least one ground contact depends from a side edge of the conductor.

17. An electrical blanking plug as claimed in claim 16, wherein the said conductor is located in a recess on the plug body, and the ground contact is located in a recess of the plug body sidewall.

18. An electrical blanking plug as claimed in claim 11, wherein the said conductor is provided with a pair of legs located in corresponding recesses provided in the plug body.

* * * * *